United States Patent [19]

Palmaer

[11] 4,224,694

[45] Sep. 30, 1980

[54] ACCESSORY SUPPORT MEMBER FOR A HELMET

[76] Inventor: Tore G. Palmaer, Kvarnliden, S-330 30 Gnosjö, Sweden

[21] Appl. No.: 916,530

[22] Filed: Jun. 19, 1978

[30] Foreign Application Priority Data

Jul. 1, 1977 [SE] Sweden ..... 7707661

[51] Int. Cl.[2] ..... A61F 11/02; A42B 3/00

[52] U.S. Cl. ..... 2/422; 2/424; 2/8; 2/423

[58] Field of Search ..... 2/422, 4, 6, 423, 424, 2/425, 15, 10, 410, 8

[56] References Cited

U.S. PATENT DOCUMENTS

| | | | |
|---|---|---|---|
| 2,410,256 | 10/1946 | Anderson et al. | 2/8 |
| 2,544,457 | 3/1951 | Harrington | 2/8 |
| 2,649,019 | 8/1953 | Hartline et al. | 2/8 |
| 2,700,158 | 1/1955 | Larsen | 2/8 |
| 3,273,164 | 9/1966 | Thomas | 2/209 |
| 3,332,086 | 7/1967 | Simpson et al. | 2/8 |
| 3,946,466 | 3/1976 | Sakai | 2/10 |

*Primary Examiner*—Werner H. Schroeder
*Assistant Examiner*—Andrew M. Falik

[57] ABSTRACT

An accessory support member in which a flat plate is provided with two portions adapted to embrace the rim of a variety of types and sizes of protective helmet. The support member is provided with a variety of removable accessories mounted by connections which enable movement of these accessories and for normal uses.

4 Claims, 7 Drawing Figures

ACCESSORY SUPPORT MEMBER FOR A HELMET

BACKGROUND OF THE INVENTION

1. Field of the Invention

This invention relates to a support member and more particularly to an accessory support member for a protective helmet.

The present invention also relates to a helmet attachment for a crash-helmet or protective helmet and more particularly to a helmet attachment adapted to carry helmet accessories such as ear-protectors, a face shield in the form of a visor and/or a rain shield in the form of a protective curtain adapted to cover the back of a persons neck.

2. Description of the Prior Art

Conventional helmet attachment means for ear-protectors or ear-phones, for instance, are screwed onto the helmet which must therefore be provided with holes. Another type of helmet attachment means which has been proposed is retained by means of an adjustable band tied around the helmet immediately above its lower peripheral edge. Neither of these known types of helmet attachment means are adapted to facilitate the mounting of several separate helmet accessories which may be attached and removed independently.

SUMMARY OF THE INVENTION

The invention seeks to provide a helmet attachment means which it will be possible to fit a variety of helmet types without making holes in the helmet and without using special bands extending around the helmet immediately above the edge of the helmet and requiring special fitting and stretching and which will permit independent fitting and removal of such accessories as ear-protectors, face shields and/or rain shields.

According to a first aspect of this invention, there is provided an accessory support member for a protective helmet, said support member comprising a substantially flat mounting portion, mounting means being provided on said mounting portion, said mounting means being adapted to facilitate the independent mounting of a plurality of helmet accessories on said mounting portion, and lug means, said lug means extending from said mounting portion and being adapted to embrace a peripheral rim portion of a helmet thereby to facilitate attachment of said support member to one side of the helmet.

According to another aspect of the invention, there is provided a helmet attachment means for mounting helmet accessories on a helmet, said means comprising a pair of accessory support members, each said support member comprising a substantially flat mounting portion, mounting means being provided on said mounting portion, said mounting means being adapted to facilitate the independent mounting of a plurality of helmet accessories on said mounting portion, and lug means, said lug means extending from said mounting portion and being adapted to embrace a peripheral rim portion of a helmet thereby to facilitate attachment of said support member to one side of the helmet, anchor means being provided where necessary for anchoring said pair of support members in position on the helmet.

According to a further aspect of this invention, there is provided a connecting arrangement for linking a helmet accessory with helmet attachment means, said arrangement comprising a support plate and means to facilitate its attachment to the helmet attachment means; a link mechanism comprising two arms pivotally connected at one end to said support plate, a straight arm constituting a first one of said arms, an angled arm, constituting a second one of said arms, said arms being adapted pivotally to be connected at their ends to a helmet accessory such as, for example, a visor, the arrangement being such that said link arms are capable of movement only between two distinct positions corresponding to a raised and lowered position of the helmet accessory.

BRIEF DESCRIPTION OF THE DRAWINGS

In order that the invention may be more readily understood and so that further features thereof may be appreciated, the invention will now be described by way of example and with reference to the accompanying drawings, in which.

DETAILED DESCRIPTION OF PREFERRED EMBODIMENTS

Figure 1:
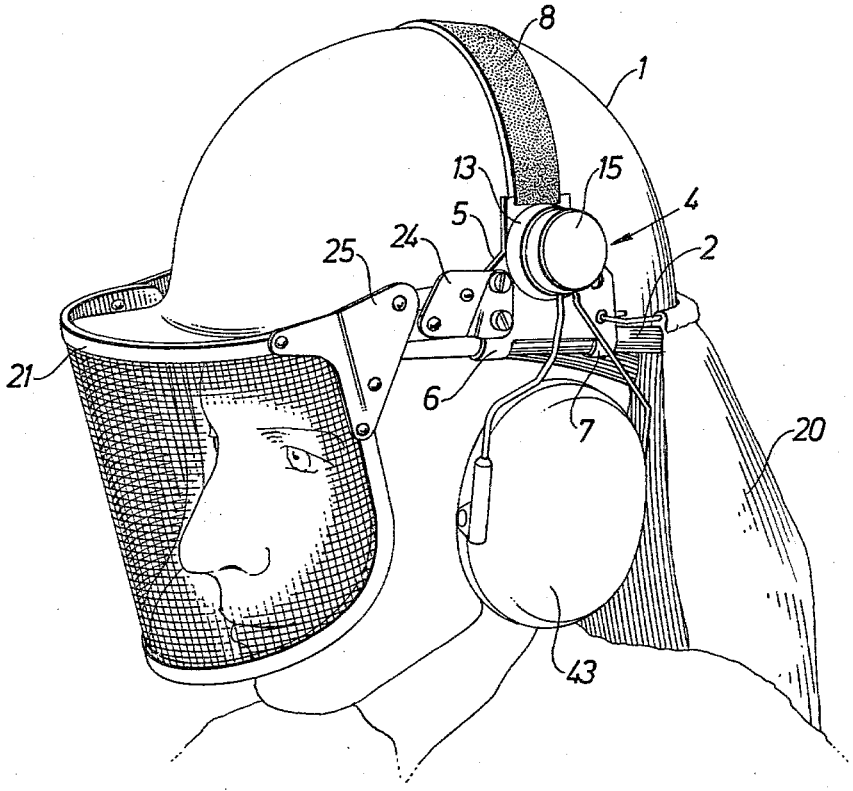
FIG. 1 is a schematic perspective view of a person wearing a helmet provided with a helmet attachment according to one aspect of the invention, the helmet attachment having independently mounted thereon several accessories.

Referring to the drawings, FIG. 1 shows a protective helmet 1 having a lower edge 2 curving outward and upward to form a peripheral flange, the edge 2 thus defining a channel to allow water to run off. This type of protective helmet is usually known as a lumbering helmet, as opposed to an industrial helmet which has an edge section which curves outwardly but does not define a water run-off channel. At each side of the helmet 1, on a line with the ears, is an accessory support member 4 which serves the dual purpose of providing a carrying member for various types of helmet accessories such as ear-protectors, which may include ear-phones and to which may be attached a mouth-piece, a visor and/or a rain shield, and also of providing attachment means by which the support member 4 may be attached to a helmet. The two support members 4 each comprise a flat element 5 which, when in position on the helmet 1, extends part way up the side of the helmet from the lower edge 2. Each plate 5, has sufficient height and width to facilitate the attachment of various helmet accessories. Furthermore, each support member 4 has extending from the lower periphery of the plate 5 two hooklike tongues 6, 7 spaced from each other and curving inwardly and upwardly, these tongues being slightly turned in relation to each other to correspond to the curve of the lower edge 2 of the helmet. The tongues act as gripping members to embrace the lower edge 2 of the helmet from below, as can be seen in FIG. 1. In the embodiment shown in FIGS. 1 and 2 the tongues 6, 7 are not provided with means adapted to grip the edge of the helmet independently to retain the support members 4 in position and thus in this case the support members 4 are clamped on by means of a rubber or resilient band 8. The band 8 is stretched over the crown of the helmet 1 and secured by means of a pin 9 at each end to an upper end section 10 of each plate 5, these sections 10 being provided with suitable recesses 11 to take one end of the band 8 and transverse holes 12 to receive said pin 9. The tension in the band 8 urges the tongues 6, 7 upwardly against the lower edge 2 of the helmet and by this means the support members 4 are retained firmly in position. Although the band 8 of the embodiment shown in FIGS. 1 and 2 is of predetermined length, if it is contemplated that the helmet attachment will be required to fit a large range of helmet size an adjustable band may be provided.

Figure 2:
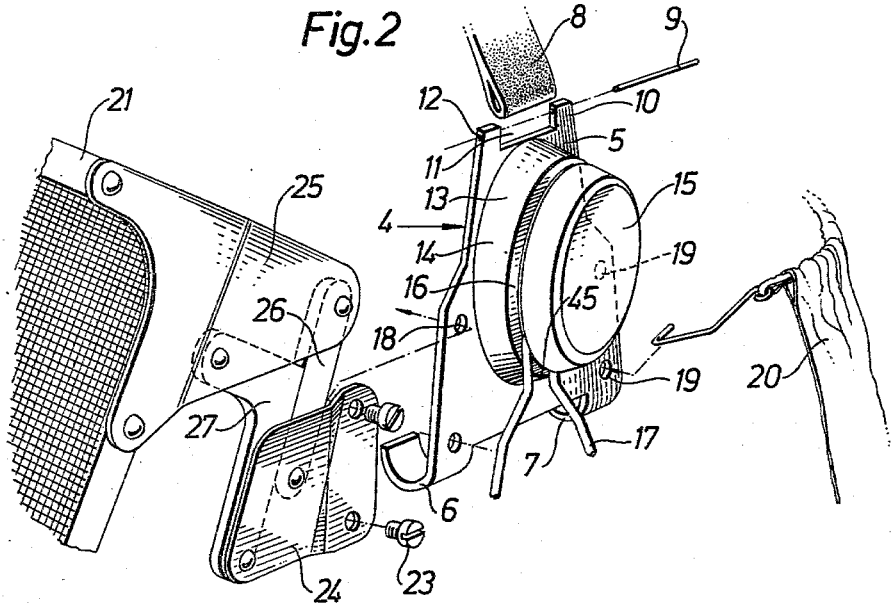
FIG. 2 is a part cut-away exploded view of the helmet attachment and accessories of FIG. 1.

Each plate 5 has a central opening whereby a holder 13 for an ear-protector can be fitted (see FIG. 2). The holder 13 comprises an inner part 14 and an outer cover part 15, the inner part 14 having a bottom plate with a rear section corresponding in shape to that of the central opening, an annular section and a central protrusion having an internally threaded aperture to receive an externally threaded mating protrusion located centrally on the lower side of the lid 15. The inner part 14 is firmly screwed by its bottom plate to the plate 5 and the cover part 15 is screwed to the inner part 14. As can be seen from the drawings, a gap 16 is formed between the inner part 14 and the cover part 15 into which gap 16 the metal loop 17 of an ear-protector fits. The metal loop 17 is pivotally journalled inside the holder 13 about said protrusion of the inner part 14 so that the ear-protector 43 can be turned from a position (shown in FIG. 1) in which the ear-protector will cover one ear of a person wearing the helmet 1 to a retracted position behind the support member 4. The annular section of the inner part 14 is provided at the bottom with a recess 45 adapted to receive the metal loop 17 when the ear-protector is lowered thereby to hold the ear-protector in position.

A conical rubber or resilient ring is arranged on the protrusion of the inner part 14 in such a way that it presses against the metal loop 17, it being possible to screw the cover 15 in or out to give the desired flexible clamping of the metal loop 17 by the rubber ring. Removal of the cover 15, said conical rubber ring and suitable washers, enables the ear-protector easily to be removed if, for instance, it is to be replaced by an alternative type of ear-protector, for example including earphones and having a mouth-piece attached thereto.

Each plate 5 is also provided with two pairs of holes 18, 19, one pair of holes being located in the vicinity of the forward edge of the plate 5 and the other pair 19 being located adjacent the rearmost edge of the plate 5. In the present embodiment, these edges are spaced about 7 cm apart. The support member 4 is symmetrical with respect to the vertical or longitudinal centre line and thus identical support members 4 may be placed on each side of the helmet.

The lower of the rear holes 19 of each plate 5 is used for detachably securing the rain shield 20 to the helmet by means of two hooks 22 as can be seen in FIGS. 1 and 2.

The two forward holes 18 of each plate 5 are arranged to receive screws 23 for attachment of a visor or spectacle holder comprising a connecting piece 24, on each plate 5. In the embodiment shown in FIGS. 1 and 2, the connecting pieces 24 support the visor 21 these being link mechanisms each comprising two means 26, 27 pivotally connected to one of the connecting pieces 24 and extending between the respective connecting pieces and a corresponding one of the connecting elements 25 which are riveted to the visor 21. This arrangement enables the visor to be swung between an upper rest position (shown in FIGS. 2 and 3) and a lower protective position for the face (shown in FIGS. 1 and 4).

Figure 3:
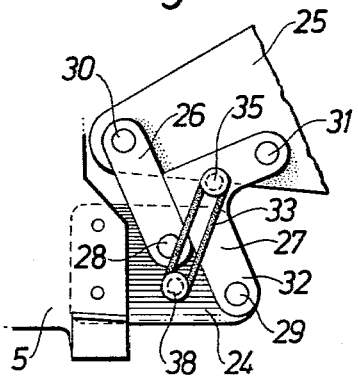
FIG. 3 shows a link mechanism for a visor of the type shown in FIGS. 1 and 2, in raised position.
Figure 4:
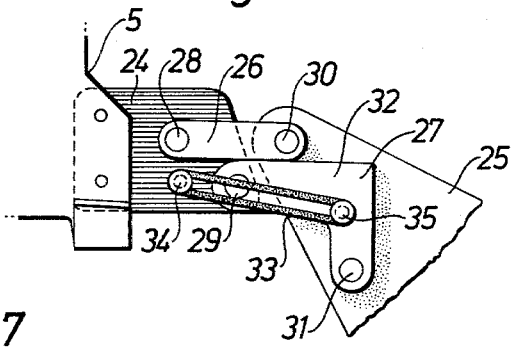
FIG. 4 shows the link mechanism of FIG. 3 when the visor is in lowered position.

As can be seen more clearly in FIGS. 3 and 4, each link mechanism consists of a straight link arm 26 and an "L" shaped link arm 27, which are pivotally journalled on one of the connecting pieces 24 and the corresponding connecting element 25 by means of journalling pins 28, 29, 30 and 31. The arrangement of the link arms is such that the arm 26 and the longer leg 32 of the "L" shaped link arm abut each other when the link mechanism is in a first corresponding to the upper, rest position of the visor (see FIG. 3) and in a second position corresponding to the lower protecting position of the visor (see FIG. 4). The straight link arm 26 and said shaft 32 of the "L" shaped link arm 27 recede from and approach each other when the visor is moved between said two positions. A resilient band 33 is also tensioned between a pin 34 on the connecting piece 24 and a pin 35 on the "L" shaped link arm 27, said pins 34, 35 being so located in relation to each other and to the fulcrum determined by the journalling pin 29 that an imaginary centre line drawn between the pins 34, 35 (i.e. the tension line of the band 33) will pass said fulcrum of the journalling pin 29 when the visor is moved between its two positions. The elastic band 33 will thus not only facilitate movement of the visor due to its inherent tensile force, but will also retain the visor by spring force in either said first or second position. Thus the visor passes through a dead centre condition.

The journalling pins 28, 29 on the connecting pieces 24, journalling pins 30, 31 on the connecting elements 25 and the attachment means comprising screws 23 and holes may be in the form of press-stud attachments to allow the visor easily to be fitted and removed when desired without the use of special tools. However, in the embodiment shown the visor can be fitted or removed from the plate without any great difficulty, with the help of a screw-driver.

Figure 6:
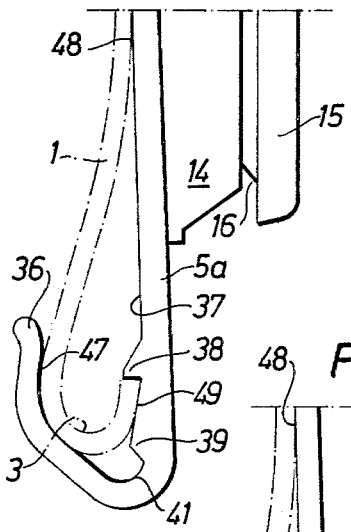
FIG. 6 is a part cut-away side view of the accessory support member of FIG. 5, detachably connected to a lumbering helmet.
Figure 7:
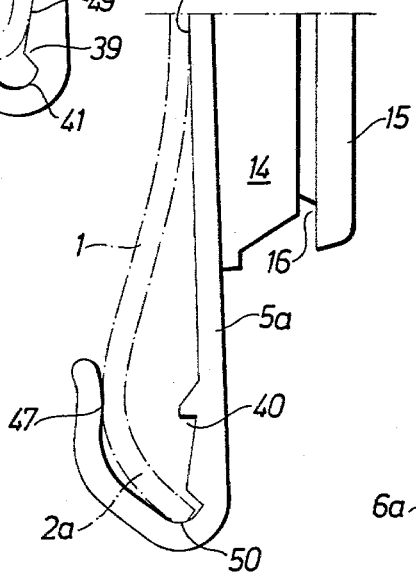
FIG. 7 is a part cut-away side view of the accessory support member of FIG. 5 detachably connected to an industrial helmet.
Figure 5:
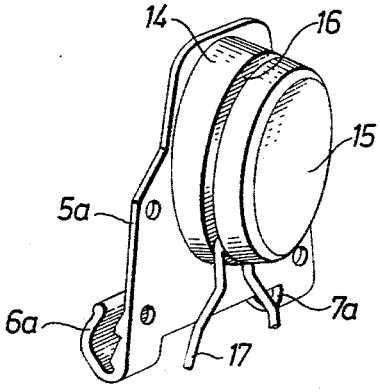
FIG. 5 is a perspective view of an alternative embodiment of an accessory support member according to a first aspect of the invention.

An alternative embodiment of support member is shown in FIGS. 5–7. In this embodiment no elastic band is required to clamp a pair of support members to a helmet and the plate 5*a* of the support member is therefore not provided with means for connecting such a band. Instead, the tongues 6*a*, 7*a* are shaped to give the requisite firm grip when the tongues are engaged with the lower edge 2*a* of a helmet. The tongues 6*a*, 7*a* in this case are adapted firmly to embrace the edge section of a helmet, the space between the free ends 36 of the tongue 6*a*, 7*a* and the facing wall 37 of the plate 54 being less than the width of the edge of the helmet. The free ends 36 of the tongues 6*a*, 7*a* will press against the inside of the helmet at a point or contact surface 47 as the outer part of the edge of the helmet is pressed at a point or contact surface 48 against the plate 5*a*. The facing wall 37 of the plate 5*a* is provided with an upper and a lower protrusion or boss 38, 39 extending laterally opposite the tongues 6a, 7a, said protrusions defining an upper slot 40 and a lower slot 41.

As may be seen from FIGS. 6 and 7, the upper slot 40 is adapted to receive the edge of a lumbering helmet (FIG. 6) and the lower slot 41 is adapted to receive the edge of an industrial helmet (FIG. 7) the arrangement in both cases being such that downward movement of the support member and hence detachment thereof is prevented, since the protrusions will serve as distinct stops which will act against the edge of the lumbering helmet (FIG. 6) or industrial helmet (FIG. 7) respectively. The support member may thus be snapped into engagement with the helmet. By turning the plate suitably however, the tongues 6a, 7a can be brought out of engagement with the edge of the helmet when desired. The free edge of the helmet thus presses against the plate 5a at a point or contact surface 49, in the case of a lumbering helmet, or a contact surface 50 in the case of an industrial helmet. Three distinct support points or surfaces thus ensure effective retention of the support member on the helmet.

If it is desired to secure the support members particularly firmly to the helmet, attachment may be effected by means of a suction body or by glueing between the plate 5a of each support member, i.e. the side 37 of the plate abutting the helmet shell, and the helmet shell itself.

Other suitable means instead of holes in the plate 5, 5a for detachable connection of the various accessories are pins or the like which are attached to or constitute part of the plate. Thus, press-stud attachment means may be used, as mentioned earlier.

The visor and spectacle holder may be used for connection to support members other than those described above, such as a loop or the like which in turn may be arranged on a helmet.

I claim:

1. A connecting arrangement for linking a helmet accessory such as a visor, with helmet attachment means, said arrangement comprising a support plate and means to facilitate its attachment to the helmet attachment means; a link mechanism comprising two independent arms, one of said arms being a straight arm and being pivotally connected at one end to said support plate and at its other end to the helmet accessory, the other of said arms being L-shaped having a short and long leg with the end of the longer leg connected to the support plate and the end of the shorter plate connected to the helmet accessory, said link arms being movable between first and second distinct positions corresponding to a raised and a lowered position of the helmet accessory, the connection of said arms being disposed as such that the first arm and the longer leg of said second arm lie parallel to each other and abut each other in said first and second position to thereby limit the said first and second positions.

2. The arrangement according to claim 1 wherein in the second or lowered position of said helmet accessory the arm and the longer leg of the second arm extend horizontally from said support plate.

3. The arrangement according to claim 1 or 2 including resilient connecting means extending between said L-shaped arm and said support plate to hold said link means in one or the other of said two positions.

4. The arrangement according to claim 3 wherein said resilient means comprises an elastic band secured at one end to said support plate and at the other end to the apex of said L-shaped arm and being aligned with the pivotal connection of the longer leg of said L-shaped arm to said support plate to thereby provide a dead center lever system.

* * * * *